US010600602B2

(12) United States Patent
Yoneda et al.

(10) Patent No.: US 10,600,602 B2
(45) Date of Patent: Mar. 24, 2020

(54) FUSE ELEMENT AND FUSE DEVICE

(71) Applicant: DEXERIALS CORPORATION, Tokyo (JP)

(72) Inventors: Yoshihiro Yoneda, Utsunomiya (JP); Chisato Komori, Oyama (JP); Kazutaka Furuta, Utsunomiya (JP); Yasushi Utsunomiya, Kanazawa (JP)

(73) Assignee: DEXERIALS CORPORATION, Tokyo (JP)

( * ) Notice: Subject to any disclaimer, the term of this patent is extended or adjusted under 35 U.S.C. 154(b) by 0 days.

(21) Appl. No.: 14/770,312

(22) PCT Filed: Mar. 27, 2014

(86) PCT No.: PCT/JP2014/059037
§ 371 (c)(1),
(2) Date: Aug. 25, 2015

(87) PCT Pub. No.: WO2014/157585
PCT Pub. Date: Oct. 2, 2014

(65) Prior Publication Data

US 2016/0013001 A1 Jan. 14, 2016

(30) Foreign Application Priority Data

Mar. 28, 2013 (JP) ..... 2013-070306
Mar. 20, 2014 (JP) ..... 2014-059135

(51) Int. Cl.
*H01H 85/06* (2006.01)
*H01H 85/50* (2006.01)
(Continued)

(52) U.S. Cl.
CPC ..... *H01H 85/06* (2013.01); *H01H 85/11* (2013.01); *H01H 85/48* (2013.01); *H01H 85/50* (2013.01); *H01H 2207/02* (2013.01)

(58) Field of Classification Search
CPC ..... H01H 85/11; H01H 85/50; H01H 85/06; H01H 85/48; H01H 2207/02
(Continued)

(56) References Cited

U.S. PATENT DOCUMENTS 2,911,504 A * 11/1959 Cohn ..... H01G 9/0003 337/159
4,320,374 A * 3/1982 Narancic ..... H01H 85/06 337/162
(Continued)

FOREIGN PATENT DOCUMENTS

JP S47-43958 A 12/1972
JP S51-49454 A 4/1976
(Continued)

OTHER PUBLICATIONS

Jun. 24, 2014 Search Report issued in International Patent Application No. PCT/JP2014/059037.

*Primary Examiner* — Anatoly Vortman
(74) *Attorney, Agent, or Firm* — Oliff PLC

(57) ABSTRACT

A fuse element capable of surface-mounting and capable of increased ratings while maintaining high-speed blowout property; and a fuse device using the same. A fuse element blown by self-generated heat caused when a rate-exceeding current flows therethrough constitutes a current path of a fuse device and has a low melting point metal layer and a high melting point metal layer laminated onto the low melting point metal layer; when the current flows therethrough, the low melting point metal layer erodes the high melting point metal layer and blowout occurs.

46 Claims, 15 Drawing Sheets

(51) Int. Cl.
*H01H 85/11* (2006.01)
*H01H 85/48* (2006.01)

(58) Field of Classification Search
USPC ..... 337/296
See application file for complete search history.

(56) References Cited

U.S. PATENT DOCUMENTS 5,898,357 A * 4/1999 Endo ..... H01H 85/11 337/159
6,917,277 B2 * 7/2005 Ohashi ..... H01H 85/055 29/623
7,312,688 B2 * 12/2007 Ely ..... H01H 85/11 337/159
8,547,195 B2 * 10/2013 Kimura ..... H01H 37/761 29/623
2005/0001710 A1 1/2005 Mukai et al.
2010/0245025 A1 * 9/2010 de Leon ..... H01H 85/0418 337/290
2015/0084734 A1 * 3/2015 Yoneda ..... H01H 37/761 337/183

FOREIGN PATENT DOCUMENTS

JP S58-122350 U 8/1983
JP S63-44357 U 3/1988
JP H01-170933 U 12/1989
JP H05-69847 U 9/1993
JP 2004-185960 A 7/2004
JP 2005-026036 A 1/2005
JP 2011-082064 A 4/2011
JP 2013-229293 A 11/2013

* cited by examiner

50

FUSE ELEMENT AND FUSE DEVICE

TECHNICAL FIELD

The present invention relates to a fuse element and a fuse device mounted on a current path that may be blown by self-generated heat when a rate-exceeding current flows therethrough, thereby interrupting the current path, and more particularly relates to a fuse element having an excellent high-speed blowout property and to a fuse device having an excellent insulating property after blowout. This application claims priority to Japanese Patent Application No. 2013-070306 filed on Mar. 28, 2013 and Japanese Patent Application No. 2014-059135 filed on Mar. 20, 2014, the entire contents of which are hereby incorporated by reference.

BACKGROUND ART

Conventionally, a fuse element is blown by self-generated heat when a rate-exceeding current flows therethrough and is used to interrupt the electrical current path. Examples of often-used fuse elements include, for example, fuses fixed by a holder wherein solder is enclosed in glass, chip fuses wherein an Ag electrode is printed onto a ceramic substrate surface, and screw-in or insertion type fuses wherein part of a copper electrode is made thinner and assembled into a plastic case.

CITATION LIST

Patent Literature

PLT 1: Japanese Unexamined Patent Application Publication No. 2011-82064

SUMMARY OF INVENTION

Technical Problem

Unfortunately, problems have been identified in the aforementioned existing fuse elements such as surface mounting using reflow being impossible, current ratings being low and increasing ratings through enlargement adversely affecting rapid blowout property.

Moreover, a hypothetical reflow-use fuse device having a high-speed blowout property would, in general, preferably use a high melting point Pb(lead)-containing solder having a melting point of more than 300° C. in the fuse element so as not to be blown by reflow heat and in order to maintain the blowout property. Unfortunately, use of solder containing Pb is limited with few exceptions under the RoHS directive, and demand for a transition to Pb-free products is expected to increase.

Thus, there is a need to develop a fuse element in which surface mounting using reflow is possible, fuse device mounting properties are excellent, ratings can be increased for application to large currents, and a high-speed blowout property in which a current path is rapidly interrupted when a rate-exceeding current flows therethrough, are achieved.

Therefore, an object of the present invention is to provide a fuse element and a fuse device using the same capable of surface mounting and wherein ratings can be increased while maintaining a high-speed blowout property.

Solution to Problem

To solve the aforementioned problem, an aspect of the present invention is a fuse element, constituting a current path of a fuse device in which self-generated heat caused by a rate-exceeding current flowing therethrough causes blowout of the fuse element, that includes a low melting point metal layer and a high melting point metal layer laminated onto the low melting point metal layer, wherein the low melting point metal layer erodes the high melting point metal layer and blowout occurs when the current flows.

Furthermore, another aspect of the present invention is a fuse device including an insulating substrate and a fuse element, which is blown by self-generated heat when a current exceeding a rating flows therethrough, mounted above the insulating substrate, wherein the fuse element has a low melting point metal layer and a high melting point metal layer laminated onto the low melting point metal layer and wherein the low melting point metal layer erodes the high melting point metal layer and blowout occurs when the current flows.

Advantageous Effects of Invention

According to the present invention, by laminating the high melting point metal layer as an outer layer on the low melting point metal layer which is an inner layer, the fuse element does not blow even in cases where reflow temperature exceeds the melting point of the low melting point metal layer. Therefore, the fuse element can be efficiently mounted by reflow.

Furthermore, the fuse element according to the present invention is melted by self-generated heat when a rate-exceeding current flows therethrough and interrupts a current path. During this event, in the fuse element, the high melting point metal layer melts at a temperature lower than a melting point thereof because the low melting point metal layer, being melted, erodes the high melting point metal layer. Therefore, the fuse element can blow rapidly by using erosion of the high melting point metal layer caused by the low melting point metal layer.

Additionally, in the fuse element, current rating can be greatly improved in comparison to components such as chip fuses of the same size because resistance is greatly lowered by the fuse element having a structure in which the high melting point metal layer, having low resistance, is laminated on the low melting point metal layer. Furthermore, thinner designs than conventional chip fuses having the same current rating are possible together with having excellent high-speed blowout property.

BRIEF DESCRIPTION OF DRAWINGS

In FIG. 4A, high melting point metal layers are arranged on an upper and a lower surface of a low melting point metal layer. In FIG. 4B, a fuse element includes a high melting point metal layer coated to the surface of a low melting point metal layer which is elongated and cut to an appropriate length. In FIG. 4C, a fuse element includes a high melting point metal layer coated to a low melting point metal layer which is in a wire form and cut to an appropriate length.

FIG. 6A is an exploded perspective view; FIG. 6B is a perspective view illustrating a configuration in which the fuse element is contained in a housing body; and FIG. 6C is a perspective view illustrating a closed configuration achieved by using a cover.

DESCRIPTION OF EMBODIMENTS

Figure 1:
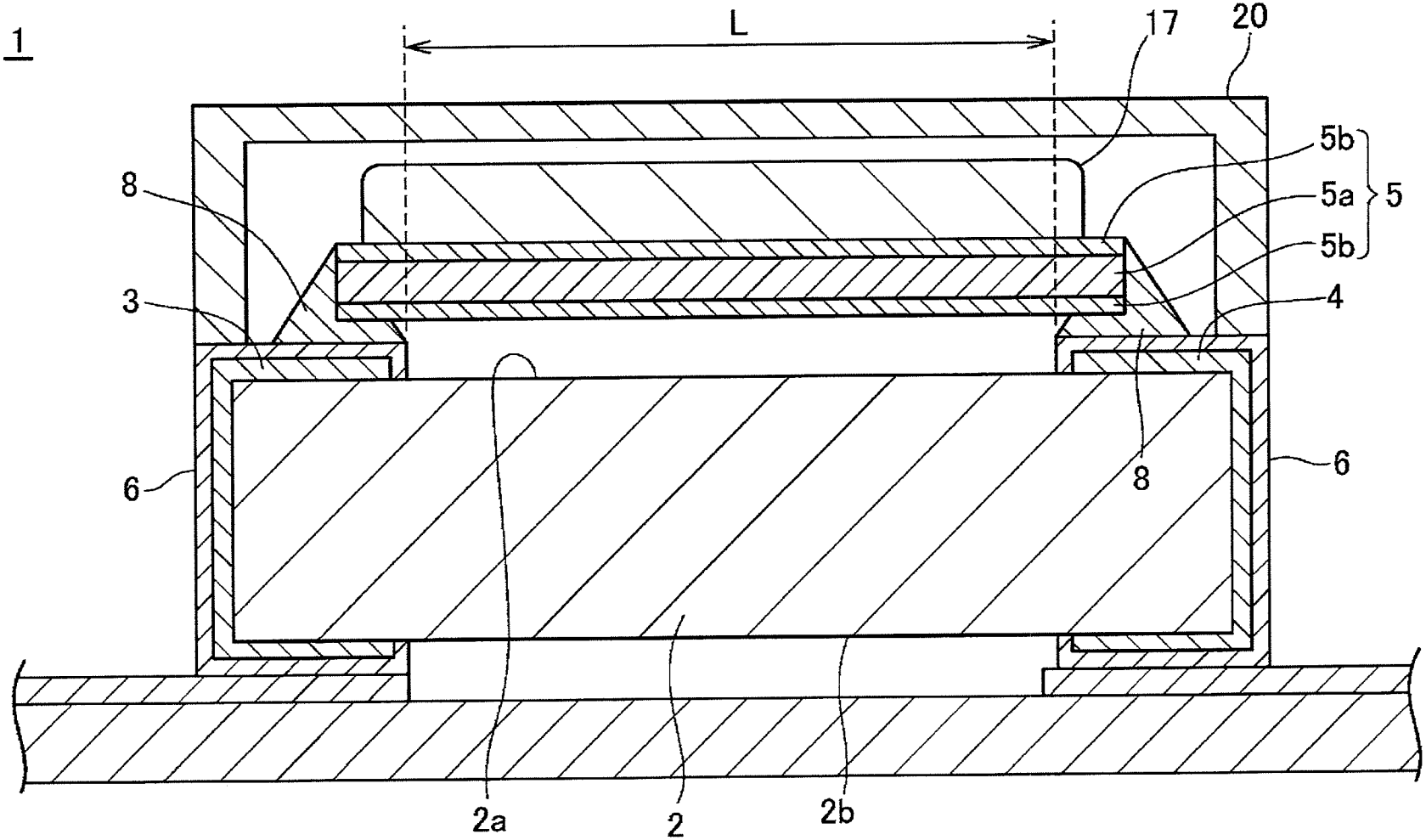
FIG. 1 is a cross-sectional view illustrating a fuse element and a fuse device according to an embodiment of the present invention.

The fuse element and the fuse device according to the present invention will now be more particularly described with reference to the accompanying drawings. It should be noted that the present invention is not limited to the embodiments described below and various modifications can be made without departing from the scope of the present invention. The features shown in the drawings are illustrated schematically and are not intended to be drawn to scale. Actual dimensions should be determined in consideration of the following description. Moreover, those skilled in the art will appreciate that dimensional relations and proportions may be different among the drawings in some parts.

First Embodiment

Fuse Device

As illustrated in FIG. 1, a fuse device 1 according to the present invention includes an insulating substrate 2, a first and a second electrodes 3, 4 provided on the insulating substrate 2 and a fuse element 5 mounted between the first and the second electrodes 3, 4 in which a current path between the first and the second electrodes 3, 4 is interrupted by blowout caused by self-generated heat caused by a rate-exceeding current flowing therethrough.

The insulating substrate 2 may be formed in a rectangular shape from insulating materials including alumina, glass ceramics, mullite and zirconia, among others. Other materials used for printed circuit boards such as a glass epoxy substrate or a phenol substrate may be used as the insulating substrate 2.

The first and the second electrodes 3, 4 are formed on opposite edges of the insulating substrate. The first and the second electrodes 3, 4 are each formed from conductive patterns made from, for example, Cu wiring. A protective layer 6, for example an Sn plating, is coated according to need to the surface of the first and the second electrodes 3, 4 as an antioxidation measure. Furthermore, the first and the second electrodes 3, 4 extend from a surface 2*a* of the insulating substrate 2 to a back surface 2*b* via a side surface. The fuse device 1 is mounted on a current path of a circuit substrate via the first and the second electrodes 3, 4 formed on the back surface 2*b*.

Fuse Element

The fuse element 5 mounted between the first and the second electrodes 3, 4 is blown by self-generated heat (Joule heat) caused by a rate-exceeding current flowing therethrough and interrupts a current path between the first and the second electrodes 3, 4.

The fuse element 5 has a laminated structure having inner and outer layers including a low melting point metal layer 5*a* as an inner layer and a high melting point metal layer 5*b* laminated on the low melting point metal layer 5*a* as an outer layer and is formed into an approximately rectangular plate. The fuse element 5 is mounted between the first and the second electrodes 3, 4 by means of a bonding material 8 such as solder and is subsequently connected above the insulating substrate 2 by means such as reflow solder bonding.

The low melting point metal layer 5*a* is preferably a metal having Sn as a primary constituent being commonly known as "Pb-free solder" (for example M705 manufactured by Senju Metal Industry Co., Ltd.). The melting point of the low melting point metal layer 5*a* does not necessarily have to be higher than a temperature of a reflow oven and the melting point may be 200° C., for example. The high melting point metal layer 5*b* is a metal layer laminated on the surface of the low melting point metal layer 5*a* and, for example, is Ag, Cu or a metal having one of these as a primary constituent having a high melting point so that the fuse element 5 does not melt even when mounted above the insulating substrate 2 from the use of a reflow oven.

In the fuse element 5, by laminating the high melting point metal layer 5*b* as an outer layer to the inner layer of the low melting point metal layer 5*a*, the fuse element 5 does not blow even in the case of reflow temperature exceeding the melting point of the low melting point metal layer 5*a*. Therefore, the fuse element 5 can be efficiently mounted by reflow.

Moreover, the fuse element 5 is also not blown by self-generated heat while a predetermined rated current flows therethrough. Furthermore, the fuse element 5 is melted by self-generated heat when a current exceeding the rating flows therethrough and the current path between the first and the second electrodes 3, 4 is interrupted. At this time, in the fuse element 5, the high melting point metal layer 5*b* melts at a temperature lower than the melting point thereof because the low melting point metal layer 5*a*, being melted, erodes the high melting point metal layer 5*b*. Therefore, the fuse element 5 can rapidly blow by using the erosive action of the low melting point metal layer 5*a* on the high melting point metal layer 5*b*. Additionally, melting metal of the fuse element 5 can quickly and reliably interrupt a current path between the first and the second electrodes 3, 4 because the first and the second electrodes mechanically draw and interrupt the fuse element 5.

Because the fuse element 5 includes the high melting point metal layer 5*b* laminated onto an inner layer of the low melting point metal layer 5*a*, the melting point thereof can be significantly lower than conventional fuses such as chip fuses made from high melting point metal. Therefore, in the fuse element 5, a cross-sectional area can be increased and ratings can be greatly improved in comparison to fuses such as equivalently sized chip fuses. Furthermore, application to designs that are smaller and thinner than conventional chip fuses having the same current rating is possible together with having an excellent high-speed blowout property.

Moreover, the fuse element 5 can improve tolerance to surges in which an exceptionally high electrical voltage is applied for a very short duration (pulse tolerance) in an electrical system into which the fuse device 1 is incorporated. For example, the fuse element 5 must not blow even in such a case as a current of 100 A flowing for a few milliseconds. Concerning this point, because a large current flows along the surface of a conductor (skin effect) for a very short duration and because the fuse element 5 includes the high melting point metal layer, being a low resistance material such as an Ag plating, as an outer layer, currents caused by surges can easily flow therethrough and a blowout caused by self-generated heat can be prevented. Therefore, surge resistibility can be greatly improved in the fuse element 5 in comparison to conventional fuses made from solder alloys.

Pulse Tolerance Test

A pulse tolerance test of the fuse device 1 will now be explained. In this test, a fuse element (example) comprising Ag plated to a thickness of 4 μm on both sides of a low melting point metallic foil (Sn 96.5/Ag/Cu) and a fuse element (comparative example) comprising a low melting point metallic foil only (Pb 90/Sn/Ag) were prepared as fuse devices. The fuse element of the example had a cross-sectional area of 0.1 $mm^2$ and a length L of 1.5 mm, and resistance of the fuse device was 2.4 mΩ. The fuse element of the comparative example had a cross-sectional area of 0.15 $mm^2$ and a length L of 1.5 mm, and resistance of the fuse device was 2.4 mΩ.

Ends of the fuse elements of the example and counter example were each solder connected (see FIG. 1) between a first and a second electrodes above an insulating substrate, a current of 100 A flew for 10 seconds in 10 msec intervals (on=10 msec/off=10 msec) and the number of pulses was counted until blowout.

TABLE 1

| | Fuse element | Cross-sectional area ($mm^2$) | Length (mm) | Fuse device resistance (mΩ) | Pulse tolerance (number of pulses) |
|---|---|---|---|---|---|
| Example | Sn96.5/Ag/Cu + Ag plating | 0.1 | 1.5 | 2.4 | 3890 |
| Comparative example | Pb90/Sn/Ag | 0.15 | 1.5 | 2.4 | 412 |

As presented in Table 1, the fuse element of the example withstood 3890 pulses until blowout, whereas the fuse element of the comparative example withstood only 412 pulses despite being larger in cross-section than the fuse element of the example. This demonstrates that a fuse element having a high melting point metal layer laminated on a low melting point metal layer has a greatly improved pulse resistibility.

It should be noted that volume of the low melting point metal layer 5*a* is preferably larger than volume of the high melting point metal layer 5*b* in the fuse element 5. In the fuse element 5, increasing volume of the low melting point metal layer 5*a* efficiently enables rapid blowout caused by erosion of the high melting point metal layer 5*b*.

For example, the fuse element 5 having a coated structure in which an inner layer is the low melting point metal layer 5*a* and an outer layer is the high melting point metal layer 5*b*, a thickness ratio of the low melting point metal layer 5*a* to the high melting point metal layer 5*b* may be from 2.1:1 to 100:1. Volume of the low melting point metal layer 5*a* can thereby be assured to be larger than a volume of the high melting point metal layer 5*b*, and rapid blowout caused by erosion of the high melting point metal layer 5*b* is enabled as a result.

Thus, in the fuse element 5, because the high melting point metal layer 5*b* is laminated to a top side and a bottom side of an inner layer of the low melting point metal layer 5*a*, a volume of the low melting point metal layer 5*a* can be made greater than a volume of the high melting point metal layer 5*b* by making a relative thickness of the low melting point metal layer to the high melting point metal layer 2.1:1 or more. However, in the fuse element 5, if the low melting point metal layer 5*a* is excessively thick and/or the high melting point metal layer 5*b* is excessively thin such that the thickness ratio of the low melting point metal layer to the high melting point metal layer exceeds 100:1, the low melting point metal layer 5*a* melted by heat during reflow mounting might adversely erode the high melting point metal layer 5*b*.

Such a film thickness range was found by preparing fuse elements having varying film thicknesses which were exposed to a temperature of 260° C. corresponding to a reflow temperature after mounting these on a first and a second electrodes 3, 4 using solder paste and observing whether or not the fuse elements were blown.

Ag was plated to a thickness of 1 μm onto the top and bottom surfaces of a low melting point metal layer 5*a* (SN 96.5/Ag/Cu) having a thickness of 100 μm to form a fuse element in which the Ag plating melted and element form was not maintained under a temperature of 260° C. In consideration of surface mounting using reflow, it was confirmed that a high melting point metal layer 5*b* having a thickness of 3 μm or more relative to a low melting point metal layer 5*a* having a thickness of 100 μm assures maintenance of form under conditions of surface mounting using reflow. It should be noted that in cases of using Cu as the high melting point metal, maintenance of form even under conditions of surface mounting using reflow can be assured with a thickness of 0.5 μm or more.

Additionally, a ratio of the low melting point metal layer to the high melting point metal layer of 100:1 is made possible by reducing erosive properties by measures such as using Cu in the high melting point metal layer and/or by reducing Sn content in the low melting point metal layer by using an alloy having a low melting point such as Sn/Bi or In/Sn.

It should be noted that the thickness of the low melting point metal layer 5*a*, while also depending on fuse element size, is preferably 30 μm or more, in general, in consideration of spreading of erosion of the high melting point metal layer 5*b* and achieving rapid blowout.

Manufacturing Method

The fuse element 5 can be manufactured by depositing the high melting point metal 5*b* on the surface of the low melting point metal layer 5*a* by using plating techniques. The fuse element 5 can be efficiently manufactured by, for example, plating Ag to a surface of a long solder foil which can be easily used by cutting according to size at the time of use.

Additionally, the fuse element 5 may also be manufactured by bonding together a low melting point metallic foil and a high melting point metallic foil. For example, the fuse element 5 can be manufactured by pressing a rolled sheet of solder foil between two similarly rolled sheets of Cu foil or Ag foil. In this case, a material softer than the high melting point metallic foil is preferably selected for the low melting point metallic foil. By doing this, unevenness in thickness can be compensated for and the low melting point metallic foil and the high melting point metallic foil can be bonded together without voids. Additionally, the low melting point metallic foil may be made thicker beforehand because film thickness thereof is made thinner by pressing. In the case of the low melting point metallic foil protruding from ends of the fuse element because of pressing, it is preferable to trim and adjust the shape.

Additionally, thin film forming techniques such as vapor deposition and other known laminating techniques may be used to form the fuse element 5 in which the high melting point metal layer 5*a* is laminated to the low melting point metal layer 5*b*.

Figure 2:
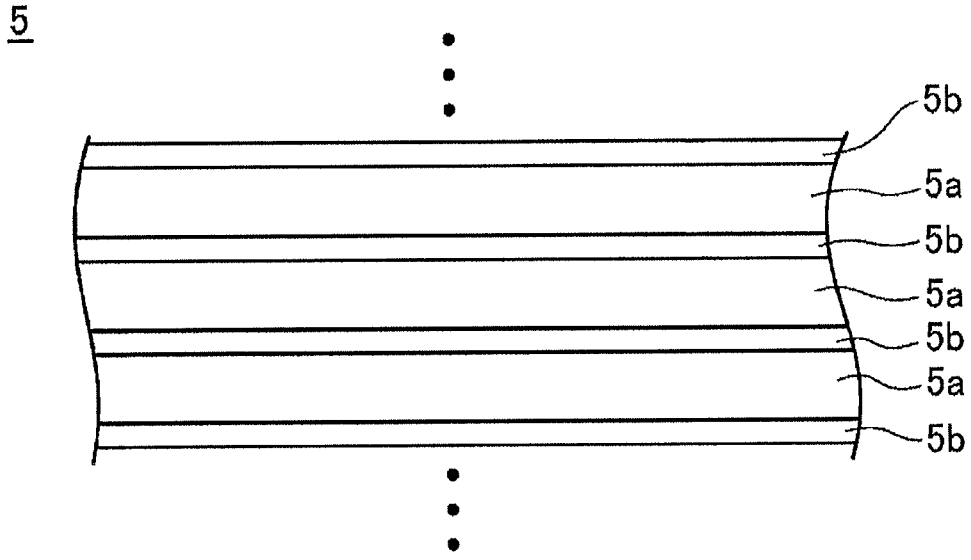
FIG. 2 is a cross-sectional view illustrating a fuse element according to another embodiment of the present invention.

Furthermore, in the fuse element 5, as illustrated in FIG. 2, the low melting point metal layer 5*a* and the high melting point metal layer 5*b* may be formed in multiple alternating layers. In this case, the outermost layer may be either the low melting point metal layer 5*a* or the high melting point metal layer 5*b*.

Figure 3:
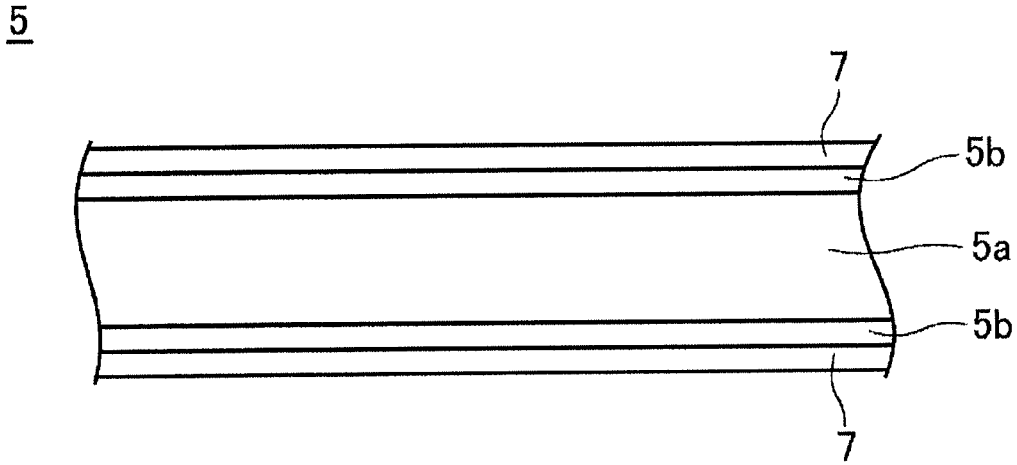
FIG. 3 is a cross-sectional view illustrating a fuse element according to another embodiment of the present invention.

Additionally, in the fuse element 5, as illustrated in FIG. 3, in cases of the outermost layer being the high melting point metal layer 5*b*, an antioxidation film 7 may be formed on the surface of the outermost layer of the high melting point metal layer 5*b*. In the fuse element 5, by further coating an antioxidation film 7 to the outermost layer of the high melting point metal layer 5*b*, for example, even in cases of the high melting point metal layer 5*b* being a Cu plating or Cu foil, oxidation of Cu can be prevented. Therefore, the fuse element 5 prevents the delay of blowout because of Cu oxidation and thus can achieve a prompt blowout.

The fuse element 5 therefore can be formed by using inexpensive but easily oxidized metals such as copper as the high melting point metal layer 5*b* without using expensive materials such as Ag.

The antioxidation film 7 of the high melting point metal layer can use the same material used in an inner layer of the low melting point metal layer 5*a* and, for example, a Pb-free solder having Sn as a primary constituent can be used. Additionally, the antioxidation film 7 may be formed by plating tin onto the high melting point metal layer 5*b*. The antioxidation film 7 may also be formed by Au plating or preflux.

Figure 4A:
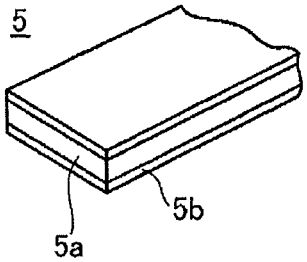
FIGS. 4A-4C are each a perspective view illustrating a fuse element according to other embodiments of the present invention.
Figure 4B:
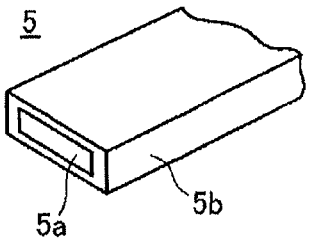

As illustrated in FIG. 4A, in the fuse element 5, the high melting point metal layer 5*b* may be laminated to an upper and a lower surface of the low melting point metal layer 5*a* or, as illustrated in FIG. 4B, exterior portions of the low melting point metal layer 5*a* excluding two opposing ends may be covered by the high melting point metal layer 5*b*.

Figure 4C:
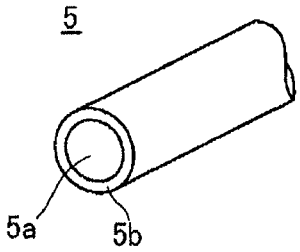

The fuse element 5 may be manufactured as a rectangular meltable conductor or, as illustrated in FIG. 4C, may be a long cylindrical meltable conductor. Furthermore, the entire surface of the fuse element 5 including ends may be covered by the high melting point metal layer 5*b*.

Figure 5:
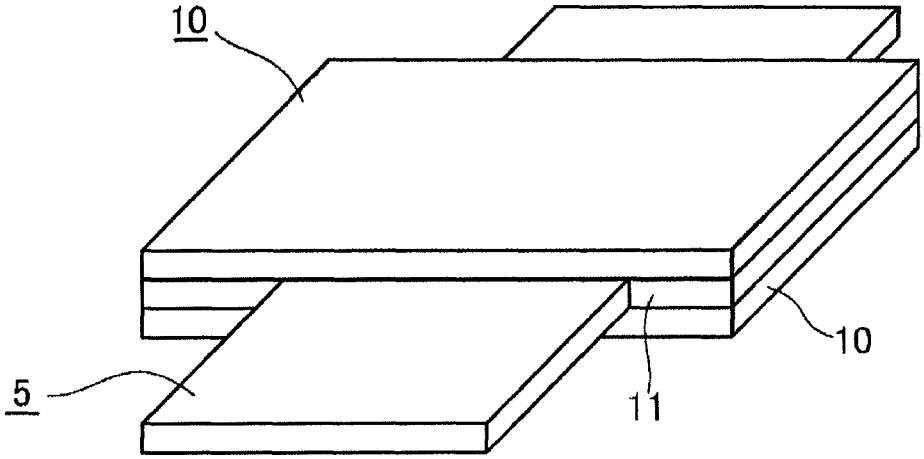
FIG. 5 is a perspective view illustrating a protective member formed on a fuse element.

As illustrated in FIG. 5, a protective member 10 may be provided on at least a portion of the exterior of the fuse element 5. During reflow mounting of the fuse element 5, the protective member 10 prevents entrance of conductive-use solder and leakage of the low melting point metal layer 5*a* and maintains the shape, and when the rate-exceeding current flows therethrough, prevents entrance of solder which prevents degradation of the high-speed blowout property which might occur otherwise due to a rating increase.

Thus, leakage of the low melting point metal layer 5*a* melted under reflow temperatures can be prevented and element shape can be maintained by providing the protective member 10 on the exterior of the fuse element 5. Particularly, where the high melting point metal layer 5*b* is laminated to a top surface and a bottom surface of the low melting point metal layer 5*a*, and the low melting point metal layer 5*a* is exposed on a side surface in the fuse element 5, leakage of low melting point metal from the side surface can be prevented and shape can be maintained by providing the protective member 10 on an exterior portion thereof.

Additionally, providing the protective member 10 on the exterior of the fuse element 5 can prevent entrance of solder melted when a rate-exceeding current flows therethrough. In the case of solder connecting the fuse element 5 above the first and the second electrodes 3, 4, heat generated by a rate-exceeding current flowing therethrough melts solder used in connections of the first and the second electrodes and also melts metal constituting the low melting point metal layer 5*a*, and the molten metal could then enter central portions of the fuse element 5 which is intended to blow. Intrusion of melted metal such as solder reduces resistance and impedes heat generation such that blowout might not occur at a predetermined current value or blowout might be delayed and insulating reliability of the first and the second electrodes 3, 4 after blowout might be adversely affected in the fuse element 5. Therefore, providing a protective member 10 to the exterior of the fuse element 5 can prevent entrance of melted metal, fix resistance value, ensure rapid blowout at a predetermined current value and ensure insulating reliability properties of the first and the second electrodes 3, 4.

Therefore, the protective member 10 is preferably a material having insulating properties, heat-tolerance appropriate for reflow temperatures and resistibility to materials such as melted solder. For example, the protective member 10, as illustrated in FIG. 5, may be formed by using an adhesive agent 11 to bond a polyimide film to a central portion of the fuse element 5, which is in a tape form. Additionally, the protective member 10 may be formed by applying an ink having insulating, heat resistance and melted metal resistance properties onto the exterior of the fuse element 5. Additionally, the protective member 10 may be formed by coating a solder resist onto the exterior of the fuse element 5.

The protective member 10, being made from materials such as films, inks and/or solder resists as described above, can be applied or coated to the exterior of the fuse element 5 having an elongated shape and the fuse element 5 having the protective member 10 arranged thereon may be cut at a time of use and has excellent handling properties.

Figure 6C:
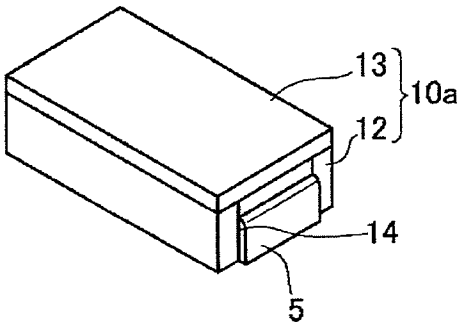
FIGS. 6A-6C illustrate a fuse element protected by a protective case.
Figure 6B:
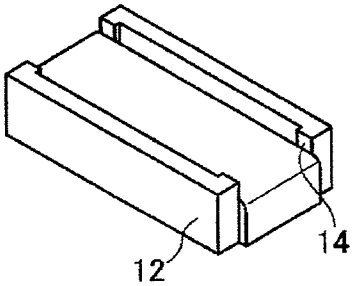
Figure 6A:
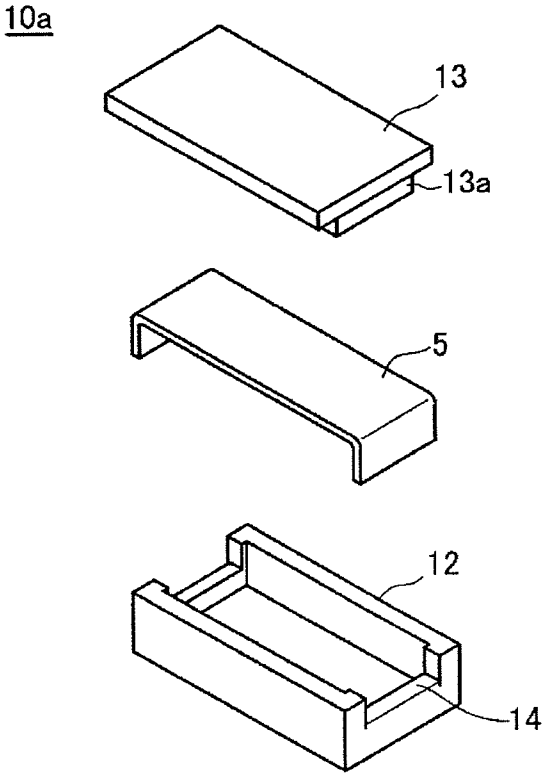

As illustrated in FIG. 6A, a protective case 10*a* for containing the fuse element 5 may be used as the protective member 10. The protective case 10*a*, for example, includes a housing body 12 having an open top and a cover 13 covering the open top of the housing body 12. The protective case 10*a* includes openings 14 allowing both ends of the fuse element 5, which are connected to the first and the second electrodes 3, 4, to protrude. The protective case 10*a* encloses the fuse element 5, with the exception of the openings 14, which allow the fuse element 5 to protrude, and prevents intrusion of melted materials such as solder into the housing body 12. The protective case 10*a* can be formed of materials such as engineering plastics having insulating, heat tolerance and resistive properties.

As illustrated in FIG. 6B, the protective case 10*a* is formed by placing the fuse element 5 into the housing body 12 having an open top, and, as illustrated in FIG. 6C, enclosing the fuse element 5 by placing the cover 13 thereon. Both ends of the fuse element 5 which connect to the first and the second electrodes 3, 4 are bent downward and protrude from the sides of the housing body 12. By covering the housing body 12 with the cover 13, the openings 14 from which the fuse element 5 protrudes are formed by a protrusion 13*a* formed on the interior surface of the cover 13 and by side surfaces of the housing 12.

The fuse element 5, in which such a protective member 10 and/or protective case 10*a* is provided, in addition to being used by being assembled into the fuse device 1 (refer to FIG. 1), may be used as a fuse device and directly surface mounted without modification onto a circuit substrate of an electrical component.

Mounting State Mounting state of the fuse element 5 will now be explained. The fuse device 1, as illustrated in FIG. 1, is mounted such that an interval exists between the fuse element 5 and a surface 2*a* of the insulating substrate 2. By doing this, in the fuse device 1, melted metal of the fuse element 5 does not adhere to the surface 2*a* of the insulating substrate 2 when a rate-exceeding current flows between the first and the second electrodes 3, 4 ensuring interruption of the current path.

In contrast, in a fuse device having a fuse element in contact with a surface of an insulating substrate such as in the case of forming a fuse element by printing to the insulating substrate, melted metal of the fuse element adheres to the insulating substrate between the first electrode and the second electrode and a leak occurs. For example, in a fuse device in which a fuse element is formed by printing Ag paste to a ceramic substrate, ceramic and silver are sintered and eroded and then remain between the first and the second electrodes. Consequently, leaking current caused by remaining material flows between the first and the second electrodes and the current path is not completely interrupted.

On the other hand, in the fuse device 1, the fuse element 5 is formed separately from the insulating substrate 2 and mounted such that an interval exists between the surface 2*a* of the insulating substrate 2. Thus, in the fuse device 1, when the fuse element 5 melts, melted metal does not erode the insulating substrate 2 but is drawn to the first and the second electrodes ensuring electrical insulation between the first and second electrodes.

Flux Coating

In the fuse element 5, as an antioxidation measure for an outer layer of either the high melting point metal layer 5*b* or the low melting point metal layer 5*a* and, at the time of blowout, to remove oxidized material and improve solder fluidity, as illustrated in FIG. 1, a flux 17 may be applied to nearly the entire surface of the exterior layer of the fuse element 5. By coating the flux 17, in addition to improving wettability of a low melting point metal (for example, solder), oxidized materials are removed during melting of the low melting point metal and a rapid blowout property can be improved by using erosion effects to the high melting point metal (for example, silver).

Furthermore, by coating the flux 17, even in cases of forming the antioxidation film 7 from such materials as Pb-free solder having Sn as a primary constituent on the surface of the outermost layer of the high melting point metal layer 5*b*, oxidized material of the antioxidation film 7 can be removed, oxidation of the high melting point metal layer 5*b* is effectively prevented, and a rapid blowout property can be maintained or improved.

This fuse element 5 may be connected in the manner described above by using reflow solder bonding to connect the fuse element 5 to the first and the second electrodes 3, 4; additionally, ultrasonic welding may also be used to connect the fuse element 5 to the first and the second electrodes 3, 4.

Figure 7:
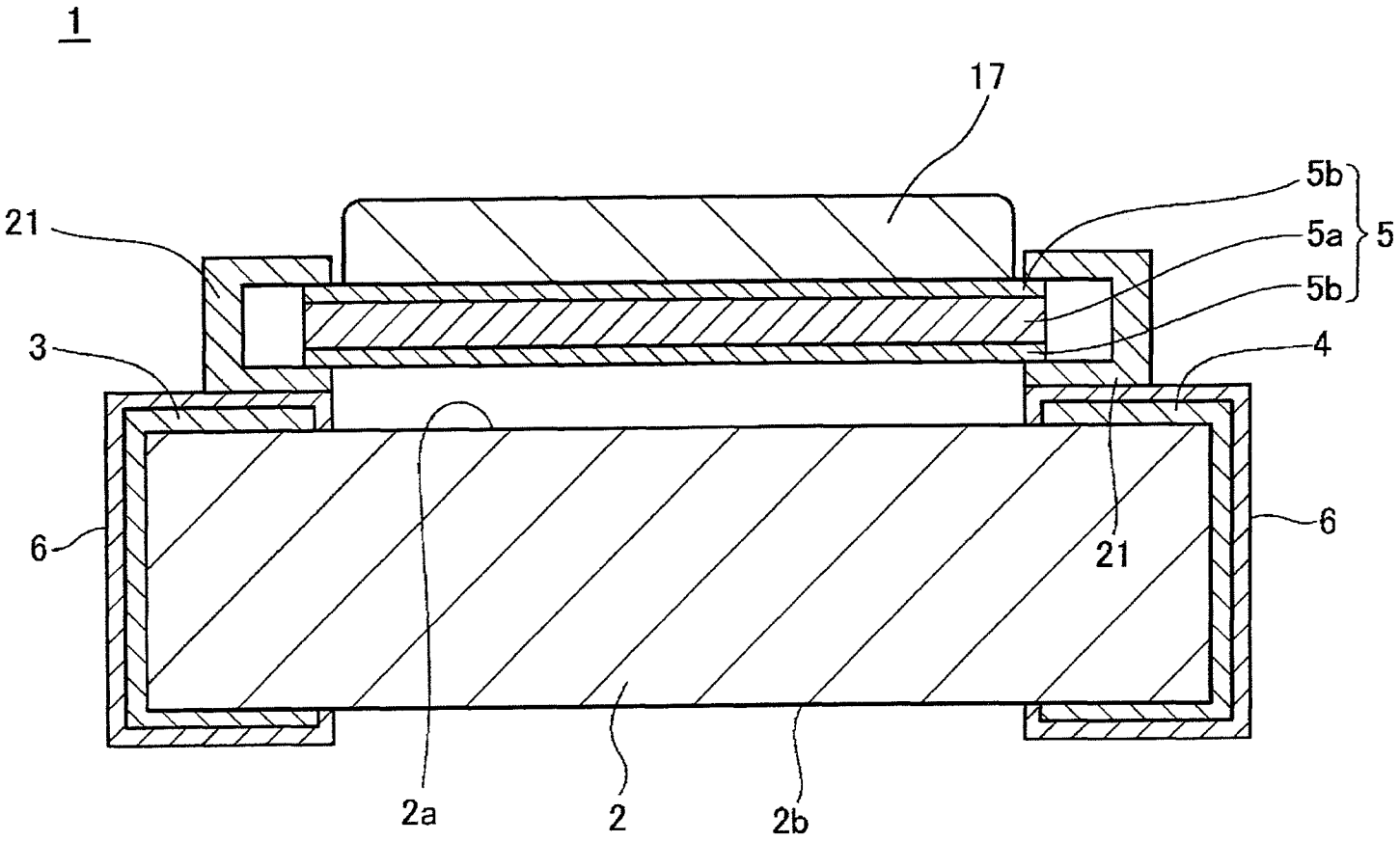
FIG. 7 is a cross-sectional view illustrating a fuse device in which a fuse element is held by clamp terminals.

Moreover, as illustrated in FIG. 7, the fuse element 5 may also be mounted by clamp terminals 21 connected to the first and the second electrodes 3, 4. The clamp terminals 21 clamp edge portions of the fuse element 5 facilitating easy connection.

Figure 8:
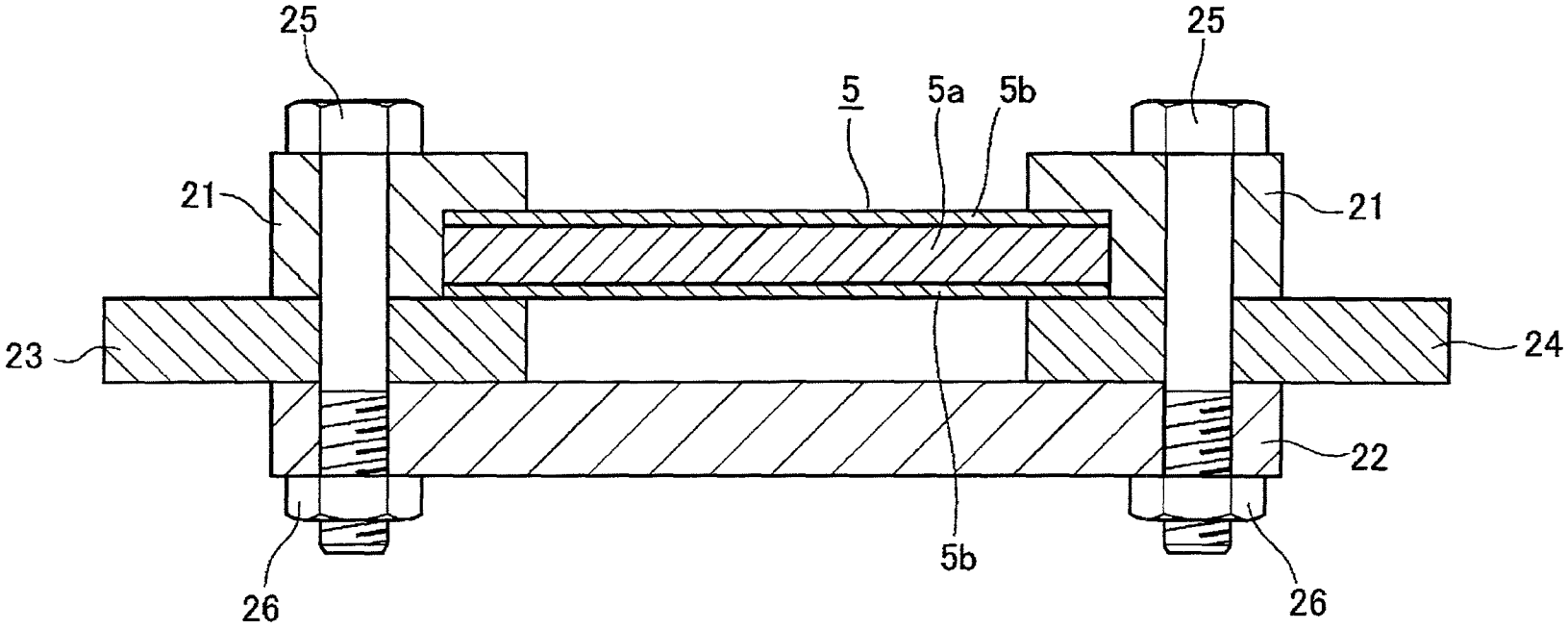
FIG. 8 is a cross-sectional view illustrating an example in which a fuse element is used as a fuse device connected by mating to clamp terminals.

The fuse element 5 mechanically connected by the clamp terminals 21, in addition to being used by being assembled into the fuse device 1, as illustrated in FIG. 8, may be used as a standalone fuse device and may be directly assembled without modification into, for example, a fuse box or a breaker device. In this case, the fuse element 5 is clamped by a first and a second cable terminals 23, 24 arranged on an insulating terminal block 22 and the clamp terminal 21; a bolt 25 fitted through the clamp terminal 21, the cable terminals 23, 24 and the insulating terminal block 22 is secured by a nut 26 or other fastener which is provided on the back surface of the insulating terminal block 22.

Covering Member

It should be noted that in the fuse device 1, as illustrated in FIG. 1, to protect the surface 2*a* of the insulating substrate 2 being so structured, a covering member 20 may be mounted on the insulating substrate 2.

The fuse element 5, in addition to being usable as in the fuse device 1 which blows due to self-generated heat caused by a rate-exceeding current flowing therethrough as described above, is also usable in a protective device for a lithium-ion secondary battery wherein a current is interrupted by blowout caused by heat generated by a heat generating element provided on an insulating substrate.

Second Embodiment

Figure 9:
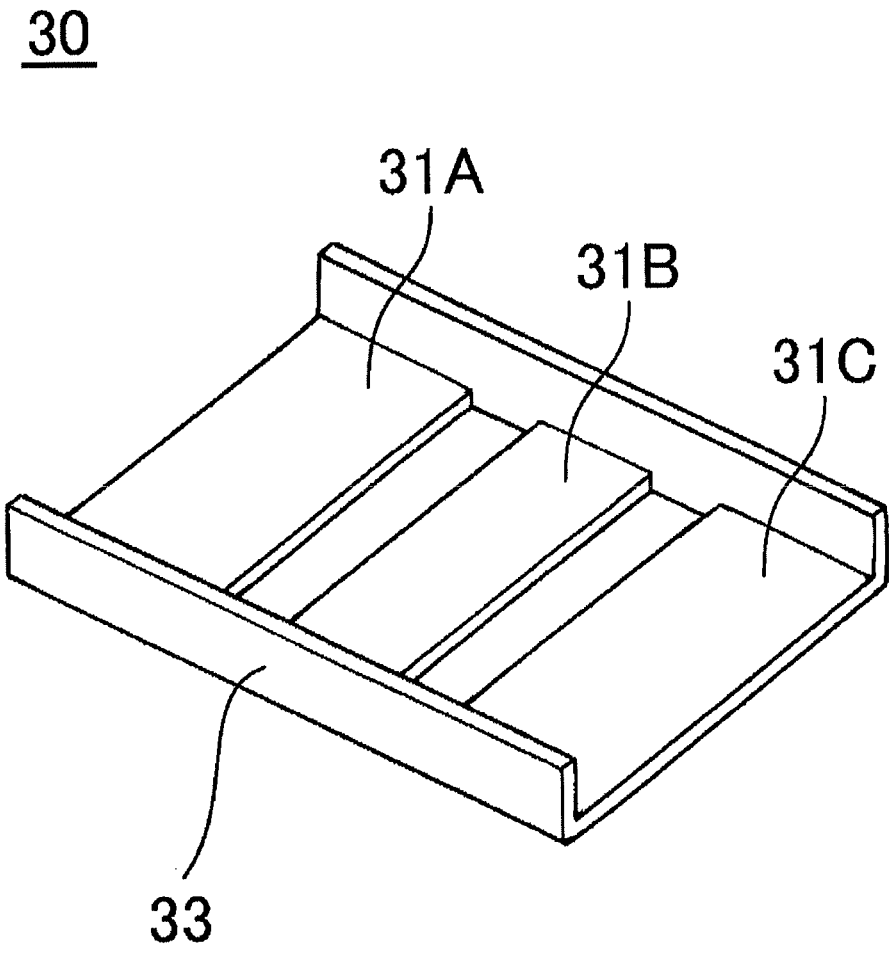
FIG. 9 is a perspective view illustrating a fuse element of another embodiment of the present invention.

Another fuse element and fuse device according to the present invention will now be explained. It should be noted that reference numerals of the fuse device 1 described above are used in the following explanation where members are the same and details thereof have been abbreviated. FIG. 9 is a perspective view illustrating a fuse element 30 and FIG. 10 is a perspective view illustrating manufacturing processes of a fuse device 40 using the fuse element 30.

As illustrated in FIG. 10, the fuse device 40 includes an insulating substrate 2 upon which first and second electrodes 3, 4 are provided, a fuse element 30 mounted such that it extends between the first and the second electrodes 3, 4, a flux 17 provided above the fuse element 30 and a covering member 20 which encloses the device above the surface 2*a* of the insulating substrate 2 on which the element 30 is situated. By mounting the fuse device 40 onto a circuit substrate, the fuse element 30 can be assembled in series on a circuit formed on the circuit substrate.

Fuse devices of a small size and a high rating are realized by the fuse device 40, for example, in consideration of dimensions of the insulating substrate 2 being 3 to 4 mm×5 to 6 mm, while being small in size, resistance values of 0.5 to 1 mΩ and increasing ratings to 50 to 60 A is possible. Those skilled in the art will appreciate that the present invention can be applied to any sizes, resistance values and current ratings.

Figure 10C:
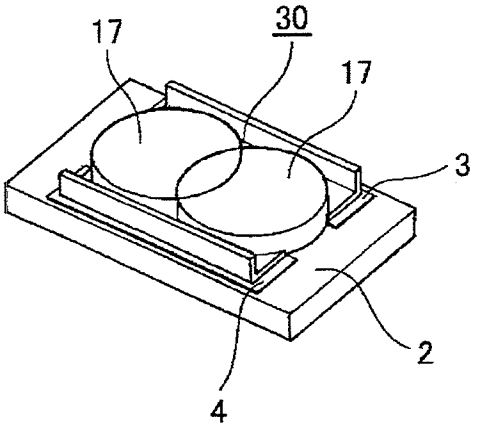
FIGS. 10A-10E illustrate production steps of a fuse device using the fuse element illustrated in FIG. 9; perspective views illustrate an insulating substrate (FIG. 10A), a configuration in which the fuse element is mounted to the insulating substrate (FIG. 10B), a configuration in which a flux has been formed on the fuse element (FIG. 10C), a configuration in which a covering member has been mounted (FIG. 10D) and a configuration in which the fuse device is mounted to a circuit substrate (FIG. 10E).
Figure 10B:
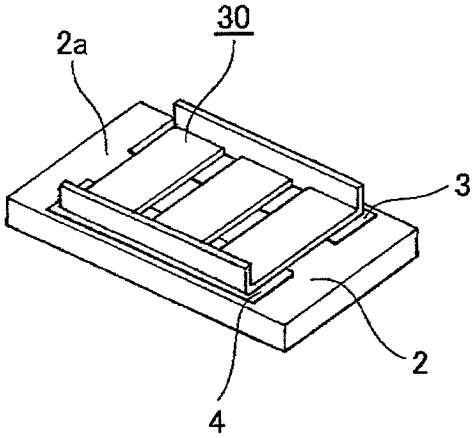

As illustrated in FIG. 9, the fuse element 30 includes multiple current paths by means of providing element components 31A to 31C in parallel. As illustrated in FIG. 10B, the element components 31A to 31C are each connected between the first and the second electrodes 3, 4 formed on the surface 2*a* of the insulating substrate 2 to constitute a current path and are blown by self-generated heat (Joule heat) caused by a rate-exceeding current flowing therethrough. In the fuse element 30, the current path between the first and the second electrodes 3, 4 is interrupted by blowout of all of the element components 31A to 31C.

The fuse element 30 has, as in the aforementioned fuse element 5, a laminated structure having an inner layer and an outer layer, and includes a low melting point metal layer 5*a* as an inner layer and a high melting point metal layer 5*b* as an outer layer which is laminated on the low melting point metal layer 5*a*. After being mounted onto the first and the second electrodes 3, 4 using an adhesive material 8 such as solder, the fuse element 30 is connected above the insulating substrate 2 by using connection methods such as reflow solder bonding. In the fuse element 30, because materials, laminated structure and manufacturing method thereof, functions and effects, excepting external form, of the low melting point metal layer 5*a* and the high melting point metal layer 5*b* are the same as in the above mentioned fuse element 5, a detailed explanation thereof has been abbreviated.

It should be noted that the low melting point metal layer 5*a* erodes the high melting point metal layer by having Sn as a primary constituent, for example, by using a metal alloy including Sn at 40% or more, a high melting point metal such as Ag is eroded and the fuse element 30 is rapidly blown.

As illustrated in FIG. 9, in the fuse element 30, the element components 31A to 31C are mounted in parallel between the first and the second electrodes 3, 4 formed on the insulating substrate 2. By doing this, when a rate-exceeding current flows through the fuse element 30 and blowout occurs, scattering of melted material from the fuse element over a wide area, formation of new current paths by scattered metal and/or adherence of scattered metal to, for example, terminals and electrical components in the surrounding vicinity can be prevented even in cases of generating arc discharge.

Figure 11A:
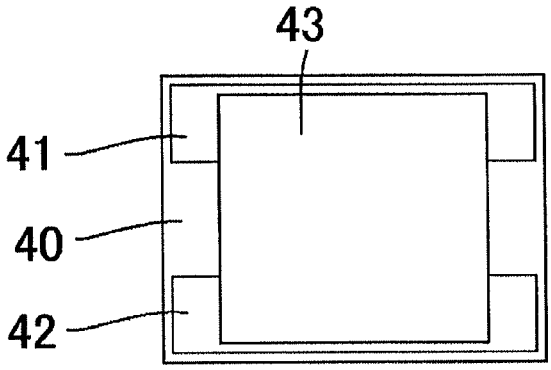
FIGS. 11A-11C illustrate blowout states of a fuse device using a fuse element using one plate-form element, i.e., in which a rate-exceeding current has begun to flow (FIG. 11A), the element has melted and gathered (FIG. 11B) and the element has explosively blown due to arc discharge (FIG. 11C).
Figure 11B:
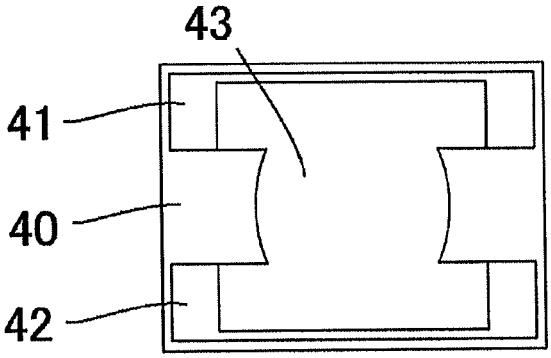
Figure 11C:
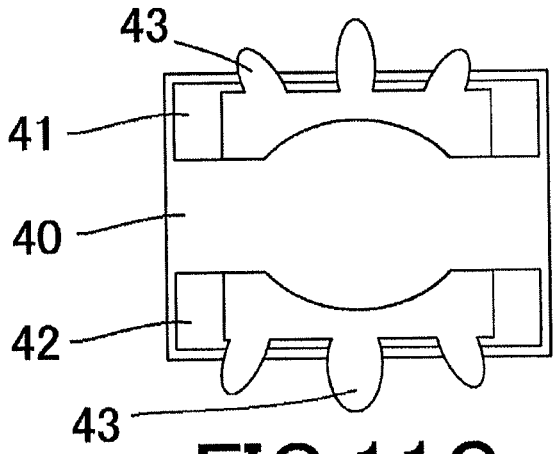

On the other hand, as illustrated in FIG. 11A, in the fuse element 43 mounted over a wide area between the electrode terminals 41, 42 mounted on the insulating substrate 40, heat is generated throughout when a rate-exceeding voltage is applied and a large current flows therethrough. As illustrated in FIG. 11B, the fuse element 43 then melts entirely and, after gathering, as illustrated in FIG. 11C, blows while generating extensive arc discharge. This causes melted material from the fuse element 43 to scatter explosively. Because of this, insulating properties can be adversely affected by creation of new current paths formed by scattered metal material, and adhesion of scattered metal to components such as electrical components in the surrounding vicinity can be caused by melting of the electrode terminals 41, 42 formed on the insulating substrate 40 which also scatter along with material from the fuse element 43. Furthermore, heat energy required to melt and cause blowout after this material has gathered together is increased which leads to poor high-speed blowout property in the fuse element 43.

Packing arc extinguishing material into hollow cases and wrapping fuse elements in a spiral around heat dissipating material to generate time lags in electrical fuses for high voltage applications have been proposed as measures for rapidly stopping arc discharge and interrupting circuits. Unfortunately, conventional electrical fuses for high voltage applications, such as those manufactured by enclosing arc-extinguishing material or using spiral fuses, require complicated materials and manufacturing processes, and are unfavorable for application to miniaturized and high-current-rated fuse devices.

In consideration of this, in the fuse element 30, because the fuse element components 31A to 31C are mounted in parallel between the first and the second electrodes 3, 4, when a rate-exceeding current flows therethrough, more current flows through element components 31 having low resistance values; the fuse element components 31A to 31C are blown in a sequence by self-generated heat, and arc discharge is generated only when the last remaining element component 31 blows. Consequently, in the fuse element 30, explosive scattering of melted metal can be prevented and insulating properties after blowout can be greatly improved even in cases of arc discharge occurring when the last remaining element of the element components 31 melts because this discharge occurs on a small scale in relation to the volume of the element components 31. Furthermore, in the fuse element 30, heat energy required to individually blow each of the element components 31 is reduced and rapid blowout is enabled because blowout occurs individually in each of the element components 31A to 31C.

In the fuse element 30, relative resistance may be increased in one of the element components 31 by making the cross-sectional area thereof smaller than the cross-sectional area of other element components. By making one of the element components 31 relatively higher in resistance in the fuse element 30, more current flows through and blows the element components 31 having relatively low resistance when a rate-exceeding current flows therethrough. Subsequently, electrical current is concentrated in the remaining element component 31 having higher resistance which blows last accompanied by arc discharge. Therefore, sequential blowout of the element components 31 can be achieved by the fuse element 30. Moreover, because arc discharge occurs when the element component 31 having a small cross-sectional area blows, this is small in scale relative to the volume of the element components 31 and explosive scattering of melted metal can be prevented.

In addition to providing three or more element components in the fuse element 30, an inner element component is preferably caused to blow last. For example, as illustrated in FIG. 9, three element components 31A, 31B and 31C are provided and the central element component 31B is preferably the last element to blow out.

Figure 12A:
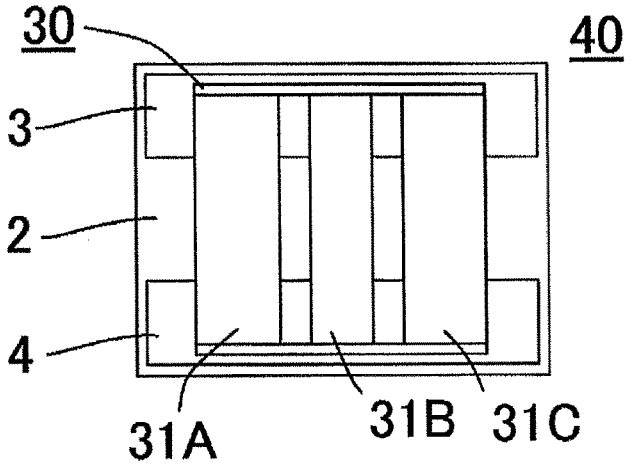
FIGS. 12A-12C illustrate blowout states of a fuse device using a fuse element including element components, i.e., in which a rate-exceeding current has begun to flow (FIG. 12A), outer element components have blown (FIG. 12B) and an inner element component has blown due to arc discharge (FIG. 12C).
Figure 12B:
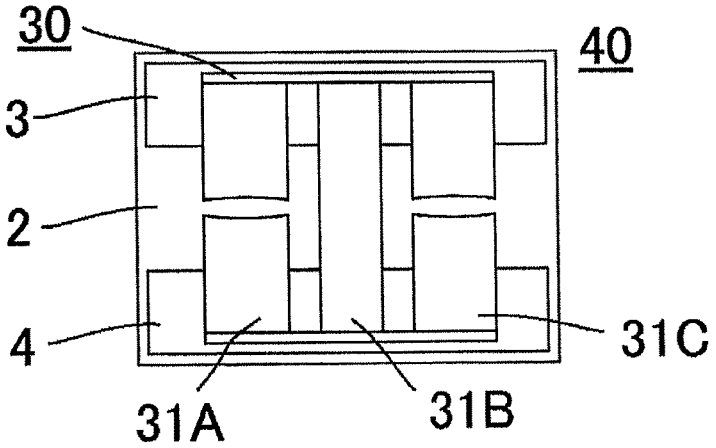

As illustrated in FIG. 12A, when a rate-exceeding current flows through the fuse element 30, firstly, more current flows through the two element components 31A and 31C causing blowout thereof by self-generated heat. As illustrated in FIG. 12B, explosive scattering of melted metal does not occur because arc discharge does not occur when the element components 31A and 31C are blown by self-generated heat.

Figure 12C:
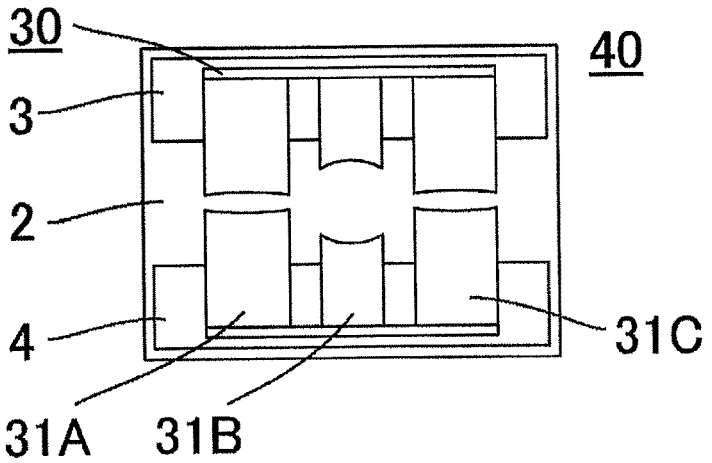

Subsequently, as illustrated in FIG. 12C, current concentrates in the central element component 31B which is then blown accompanied by arc discharge. At this time, in the fuse element 30, by causing the central element component 31B to blow last, even in the case of arc discharge generation, melted metal of the element component 31 can be trapped by the outer element components 31A and 31C which have already melted. Therefore, scattering of melted metal of the element component 31B can be controlled and problems such as short circuits caused by melted metal can be prevented.

In the fuse element 30, among the three element components 31A to 31C, by making the cross-sectional area in all or a portion of the element component 31B located in a central and inner position smaller than the cross-sectional area in the other element components 31A and 31C, which are located in outer positions, resistance thereof is relatively increased, thereby the element component 31B located in the center may be made to blow last. In this case as well, explosive scattering of melted metal can be controlled because arc discharge is small in scale relative to volume of the element component 31B and because blowout of the element component 31B occurs last by making the cross-sectional volume thereof relatively smaller.

Element Manufacturing

Figure 13A:
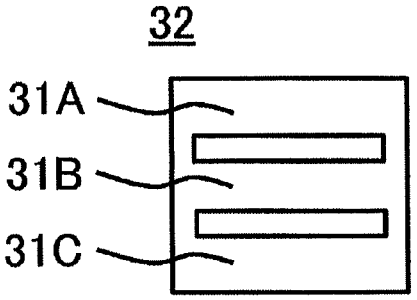
FIGS. 13A-13B illustrate a plan view illustrating a fuse element in which element components are integrally supported on both ends (FIG. 13A) and a fuse element in which element components are integrally supported on one end (FIG. 13B).
Figure 13B:
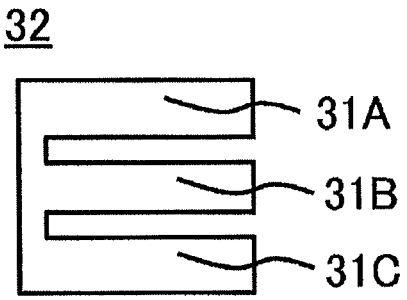

The fuse element 30 having these element components 31 can be, for example, manufactured by punching out two central locations of the laminated structure 32 of the sheet formed low melting point metal 5*a* and the high melting point metal 5*b* as illustrated in FIG. 13A. In the fuse element 30, the three element components 31A to 31C mounted in parallel are integrally supported on both ends. It should be noted that, as illustrated in FIG. 13B, the three element components 31A to 31C may be integrally supported on one end.

Terminal Portions

Furthermore, in the fuse element 30, terminal portions 33 may be provided as an external-connection-use terminal of the first and the second electrodes 3, 4 which are formed on the insulating substrate 2. The terminal portions 33 connect the fuse element 30 to a circuit formed on a circuit substrate when the fuse device 40 having the fuse element 30 mounted therein is mounted to the circuit substrate and, as illustrated in FIG. 9, are formed on both longitudinal ends of the element components 31. The terminal portions 33 are then connected to electrodes formed on the circuit substrate by materials such as solder by face-down mounting the fuse device 40 to the circuit substrate.

By electrically connecting the fuse device 40 to the circuit substrate via the terminal portions 33 formed on the fuse element 30, resistance throughout the device is lowered, thus enabling miniaturization and high ratings. For example, in the fuse device 40, in the case of providing an electrode on the back surface of the insulating substrate 2 for connecting to the circuit substrate and connecting the first and the second electrodes 3, 4 via means such as through-holes filled with conductive paste, limits such as those on bore size and number of through-holes and castellations, and limits such as those on resistance and film thickness of conductive paste, lead to difficulties in realizing resistances that are less than or equal to the fuse element and high ratings are difficult to achieve.

Figure 10A:
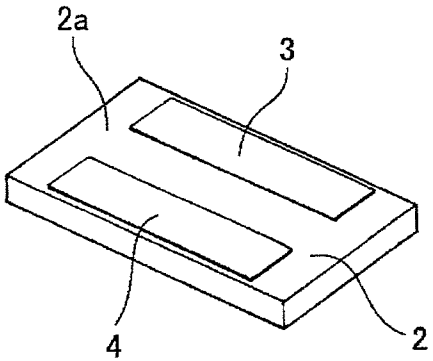
Figure 10E:
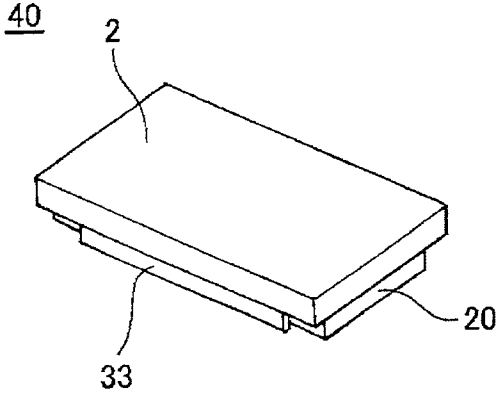

Therefore, in the fuse device 40, the terminal portions 33 are formed on the fuse element 30 and protrude outside of the device via the covering member 20. Furthermore, as illustrated in FIG. 10E, by face-down mounting the fuse device 40 onto the surface substrate, the terminal portions 33 are directly connected to an electrode of the circuit substrate. By doing this, in the fuse element 40, high resistance caused by interposing conductive through-holes can be prevented, rating can be determined by the fuse element 30, and miniaturization together with high ratings are possible.

Additionally, because forming the first and the second electrodes 3, 4 on the surface 2*a* is sufficient and forming a connecting electrode on the back surface of the insulating substrate 2 is not necessary, manufacturing workload of the fuse device 40 can be reduced by forming the terminal portions 33 on the fuse element 30.

The fuse element 30 having the terminal portions 33 formed thereon can be manufactured by, for example, stamping out the laminated structure comprising the sheet formed low melting point metal layer 5*a* and the high melting point metal layer 5*b* and bending both edge portions thereof. Additionally, manufacturing may be performed by connecting a metal plate constituting the terminal portions 33 to the first and the second electrodes 3, 4.

It should be noted that in the fuse device 40, in the case of manufacturing the terminal portions 33 by bending the fuse element 30, which is a laminated structure including the sheet formed low melting point metal layer 5*a* and the high melting point metal layer 5*b*, because the terminal portions 33 and the element components 31 are already one unit, provision of the first and the second electrodes 3, 4 on the insulating substrate 2 may be omitted. In this case, the insulating substrate 2 is used to dissipate heat away from the fuse element 30 and a ceramic substrate having good thermal conductivity is preferably used. Furthermore, an adhesive agent used to connect the fuse element 30 to the insulating substrate 2 preferably has an excellent thermal conductivity and requires no electrical conductivity.

Figure 14:
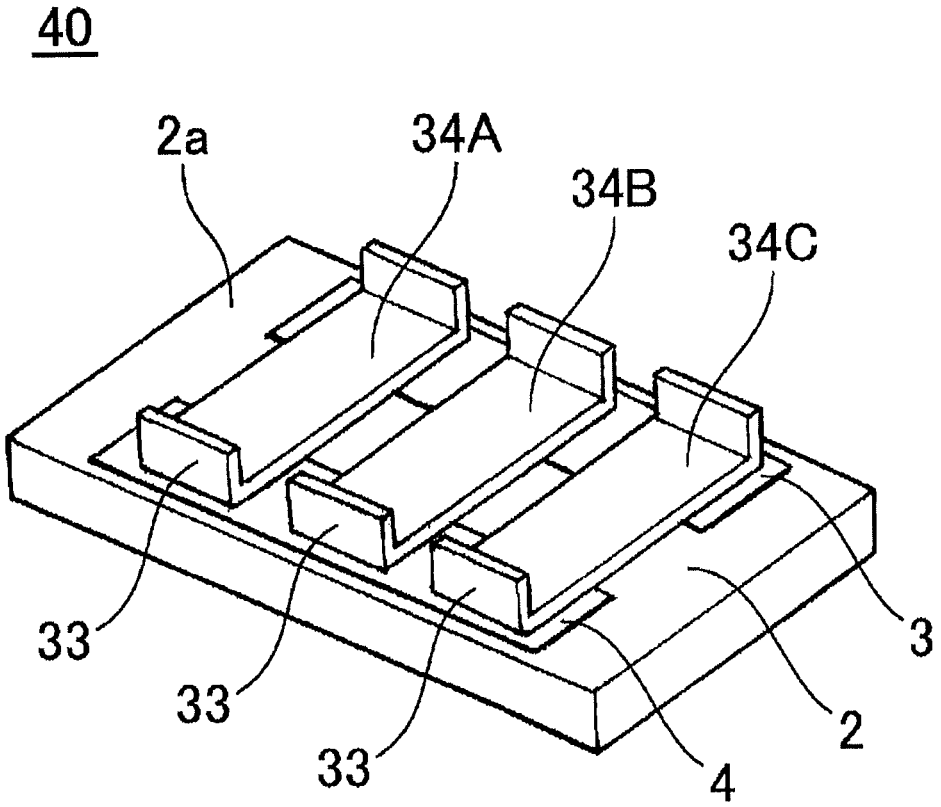
FIG. 14 is a perspective view illustrating a fuse device in which three elements are arranged in parallel.

In addition, elements 34 corresponding to the element components 31 may be connected in parallel between the first and the second electrodes 3, 4 to manufacture a fuse element. As illustrated in FIG. 14, the elements 34, for example, include three elements 34A, 34B and 34C arranged in parallel. Each of the elements 34A to 34C are formed in a rectangular shape and bent to form the terminal portions 33 on both ends. In the elements 34, the central element 34B mounted in an inner position may be made to blow last by increasing relative resistance by making the cross-sectional area of the central element 34B mounted in an inner position smaller than the cross-sectional area of the other elements 34A and 34B mounted in outer positions.

Fuse Device

The fuse device 40 using the fuse element 30 can be manufactured by the following process. As illustrated in FIG. 10A, the first and the second electrodes 3, 4 are formed on the surface 2*a* of the insulating substrate 2 having the fuse element 30 mounted thereon. The first and the second electrodes 3, 4 are connected to the fuse element 30 (FIG. 10B). By doing this, the fuse element 30 can be connected in series onto a circuit formed on the circuit substrate by mounting the fuse device 40 on the circuit substrate.

The fuse element 30 is mounted between the first and the second electrodes 3, 4 by connection materials such as solder, and is solder bonded when the fuse device 40 is reflow mounted to a circuit substrate. As illustrated in FIG. 10C, a flux 17 is provided above the fuse element 30. Forming the flux 17 prevents oxidation of the fuse element 30 and can improve wettability, thereby allowing rapid blowout. Furthermore, forming the flux 17 can suppress adhesion of melted metal caused by arc discharge to the insulating layer 2 and can improve insulation properties after blowout.

Figure 10D:
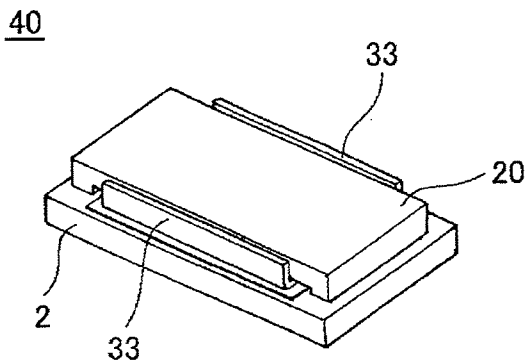

As illustrated in FIG. 10D, the fuse device 40 is completed by mounting the covering member 20 which protects the surface 2*a* of the insulating surface 2 and reduces scattering of melted metal of the fuse element 30 caused by arc discharge. In the covering member 20, a pair of legs is formed on both longitudinal ends across the width direction; these legs are positioned on the surface 2*a*, and the terminal portions 33 of the fuse element 30 protrude upwards from open sides.

As illustrated in FIG. 10E, the fuse device 40 is connected by face-down mounting wherein the surface 2*a* having the covering member mounted thereon is faced towards the circuit. By doing this in the fuse device 40, because each of the element components 31 of the fuse element 30 are covered by the covering member 20 and the terminal portions 33, melted metal is trapped by structures including the terminal portions 33 and the covering member 20 and prevented from scattering to adjacent vicinities even in the case of arc discharge.

Projecting Portions of the First and the Second Electrode

Figure 15B:
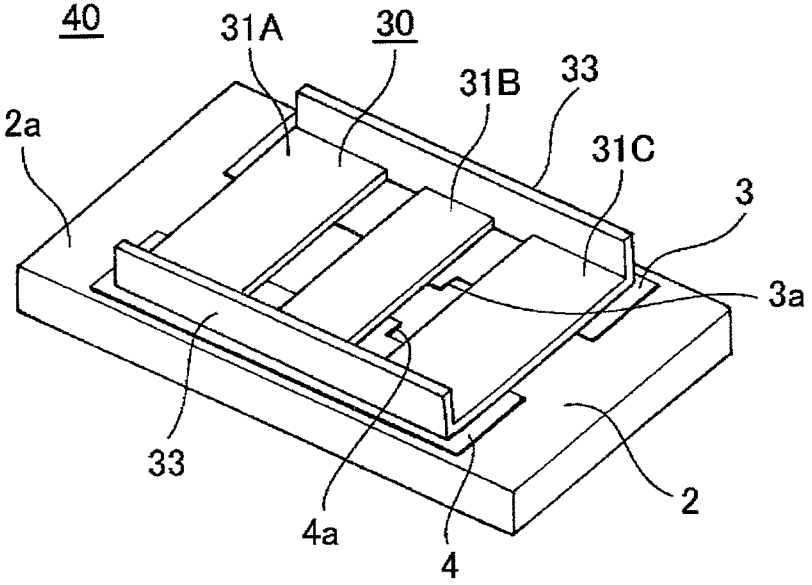
FIGS. 15A-15B illustrate a fuse device in which a first and a second electrodes have projecting portions in a plan view of an insulating substrate (FIG. 15A) and a perspective view thereof (FIG. 15B).
Figure 15A:
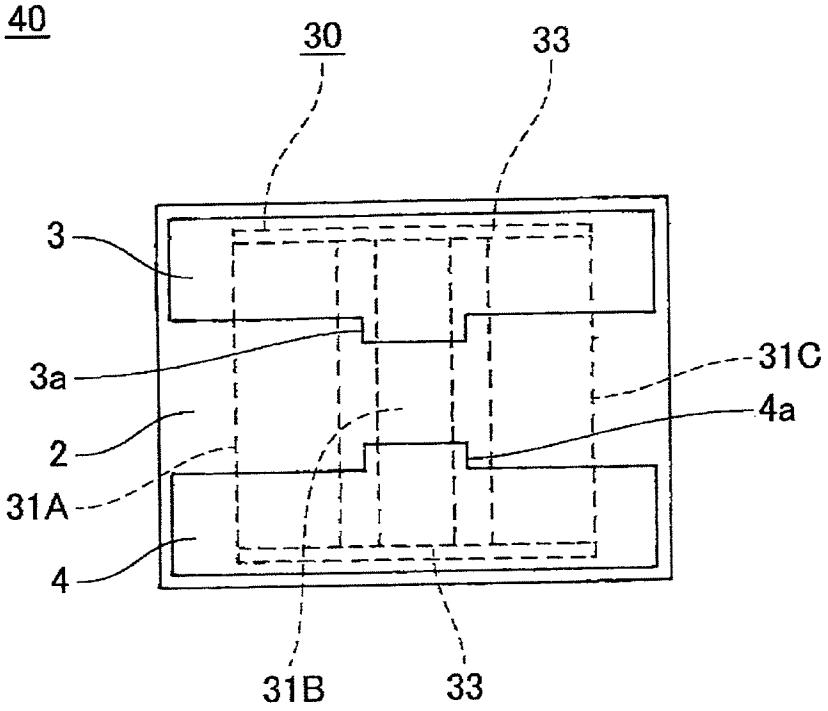

As illustrated in FIGS. 15A and 15B, areas of the first and the second electrodes 3, 4 to which one of the element components 31 connects may be formed such that projecting portions 3*a*, 4*a* protrude and the electrode distance between the projecting portions 3*a*, 4*a* is made shorter than the electrode distances between connection areas of the other element components 31.

By also mounting one of the element components 31 onto the projecting portions 3*a*, 4*a*, contact area of the element component 31 to the first and the second electrodes 3, 4 and projecting portions is increased. The element component 31, therefore, blows later than the other element components 31, even in cases of flowing electrical current causing self-generated heat, because heat is dissipated via the first and the second electrodes 3, 4 and the projecting portions 3*a*, 4*a* leading to enhanced cooling in comparison to the other element components 31, which are mounted in a position not having the projecting portions 3*a*, 4*a*. By doing this in the fuse device 40, the element components 31 of the fuse element 30 can be made to blow in a sequence.

Additionally, by providing the projecting portions 3*a*, 4*a*, distance between electrodes is made shorter in comparison to the other element components. Because longer electrode distance causes the element components 31 to be more prone to blowout, the element component 31 mounted on the projecting portions 3*a*, 4*a* is less prone to blowout and blows later than the other element components 31. This is another means by which the element components 31 of the fuse element 30 can be made to blow in a sequence in the fuse device 40.

Furthermore, the fuse device 40 uses the fuse element 30 including three or more element components; in the first and the second electrodes 3, 4, the projecting portions 3*a*, 4*a* are provided at a position for mounting the inner element component 31 which is preferably made to blow last. For example, as illustrated in FIG. 15, in using the fuse element 30 comprising the three element components 31A, 31B and 31C, the central element component 31B is preferably made to blow last by means of enhanced cooling and shorter distance between electrodes achieved by providing the projecting portions 3*a*, 4*a* in a mounting position of the central element component 31B.

In the fuse element 30 described above, because arc discharge occurs when the last of the element components 31 blows, by making the central element component 31B be the last element component to blow, even in the case of arc discharge generation, melted metal from the element component 31B can be caught by the outer element components 31A, 31C being previously melted. Consequently, scattering of melted metal from the element component 31B can be controlled and problems such as short-circuits caused by melted metal can be suppressed.

It should be noted that, in the fuse element 30, among the three element components 31A to 31C, the central element component 31B may be made to blow last by increasing relative resistance by making the cross-sectional area of a part or all of the inner element component 31B smaller than that of the other outer element components 31A, 31C. In this case as well, because the element component 31B is made to blow last by making the cross-sectional area relatively small, arc discharge can be made small in relation to the volume of the element component 31B.

Figure 16C:
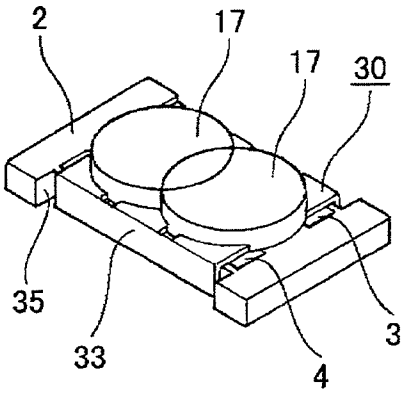
FIGS. 16A-16D illustrate production steps of another fuse device using the fuse element illustrated in FIG. 9; perspective views illustrate an insulating substrate (FIG. 16A), a configuration in which the fuse element is mounted to the insulating substrate (FIG. 16B), a configuration in which a flux has been formed on the fuse element (FIG. 16C) and a configuration in which a covering member has been mounted and the fuse device has been mounted to a circuit substrate (FIG. 16D).
Figure 16B:
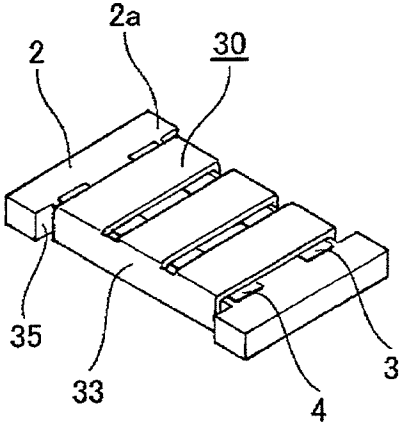

Furthermore, in a fuse device according to the present invention, as illustrated in FIG. 16B, in addition to forming the fuse element 30 and the terminal portions 33 integrally, the terminal portions 33 may be fitted to a side surface of the insulating substrate 2 and may be made to protrude to the back surface of the insulating substrate 2.

Figure 16A:
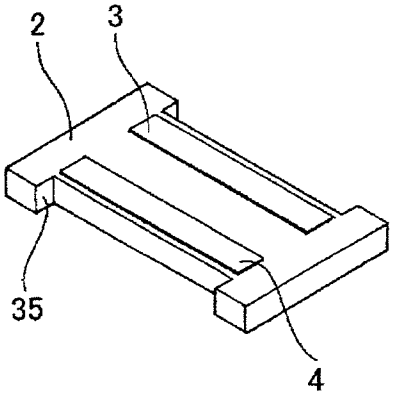
Figure 16D:
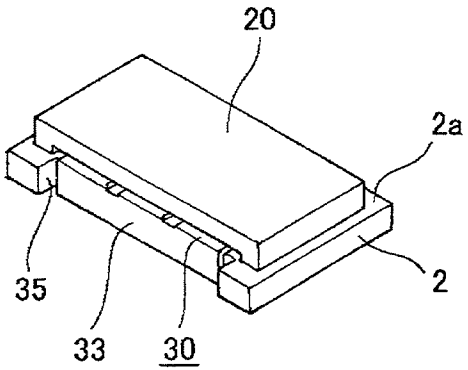

FIG. 16C illustrates a fuse device 50 manufactured by providing the flux 17 above the fuse element 30, and then mounting the covering member 20 above the surface 2*a* of the insulating substrate 2, as illustrated in FIG. 16D. The terminal portions 33 protrude from open sides of the covering member 20 towards the back surface side of the insulating substrate 2. It should be noted that, in the fuse device 50, mounting of the covering member 20 is not always necessary.

By using a connective material such as solder, the fuse device 50 is then mounted such that the back surface of the insulating substrate 2 faces the circuit substrate. By doing this, in the fuse device 50, the terminal portions 33 are connected to electrodes formed on the circuit substrate and the fuse element 30 is connected in series to a circuit on the circuit substrate.

As illustrated in FIG. 16A, in this fuse device 50, by forming an engagement recess 35 for engaging the terminal portions 33 of the fuse element 30 on a side surface of the insulating substrate 2, mounting position of the fuse element 30 can be fixed without increasing the mounting area on the circuit substrate.

It should be noted that, in the fuse device 50 illustrated in FIG. 16, formation of the first and the second electrodes 3, 4 on the surface 2*a* of the insulating substrate 2 may be omitted. This reduces the number of steps for manufacturing the fuse device 50 because forming electrodes on the surface 2*a* of the insulating substrate 2 is not necessary.

Additionally, in the fuse device 50, the insulating substrate 2 is used to dissipate heat from the fuse element 30 and a ceramic substrate having a good thermal conductivity is preferably used. Furthermore, adhesive agent used to connect the fuse element 30 to the insulating substrate 2 preferably has an excellent thermal conductivity and requires no electrical conductivity. Still further, an electrode for dissipating heat from the fuse device 50 may be formed on the back surface of the insulating substrate 2.

Figure 17:
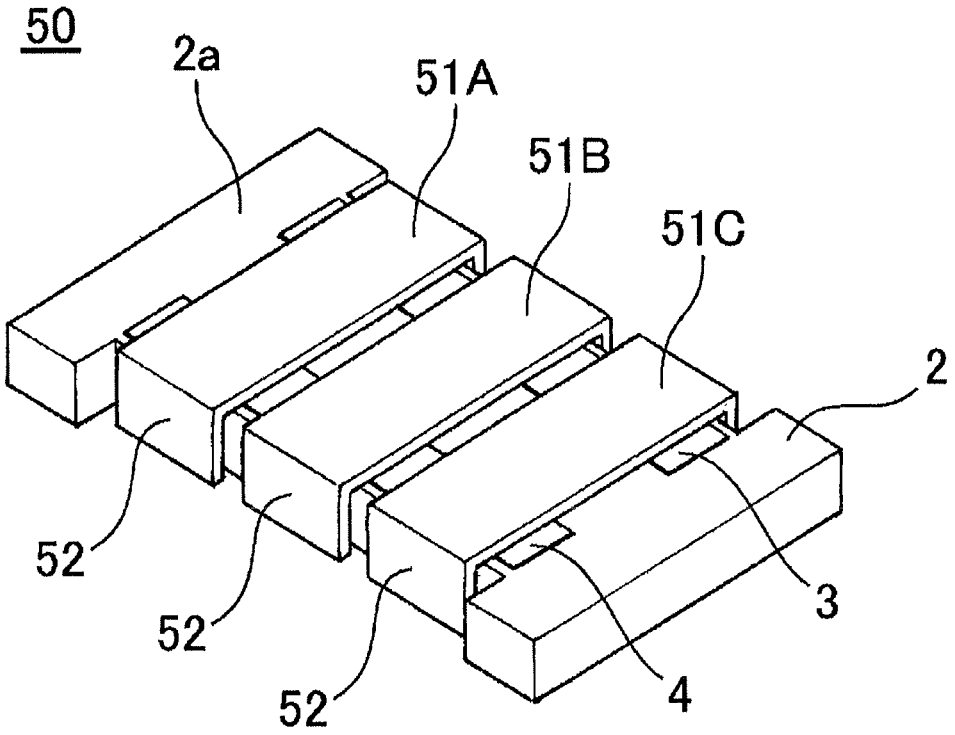
FIG. 17 is a perspective view illustrating another fuse device using another fuse element.

As illustrated in FIG. 17, the fuse device 50 may be manufactured by connecting elements 51 corresponding to the element components 31 in parallel between the first and the second electrodes 3, 4. Each of the elements 51 have terminal portions 52 formed by bending and the terminal portions 52 are fitted to side surfaces of the insulating substrate 2 and protrude to the back surface side of the insulating substrate 2.

In this case as well, formation of the first and the second electrodes 3, 4 provided on the surface 2*a* of the insulating substrate 2 may be omitted. Additionally, three of the elements 51 are arranged in parallel in the fuse device 50 and a central element mounted in an inner position may be made to blow last by increasing relative resistance by making the cross-sectional area of the central element 51B smaller than the cross-sectional area of the other outer elements 51A, 51C.

Separation of the First and the Second Electrode

Figure 18A:
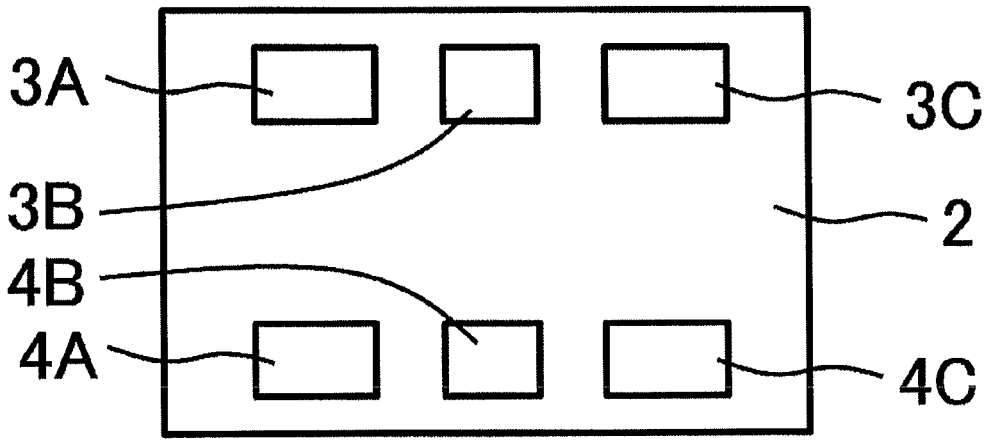
FIGS. 18A and 18B are plan views illustrating a first and a second separated electrodes formed on an insulating substrate.
Figure 18B:
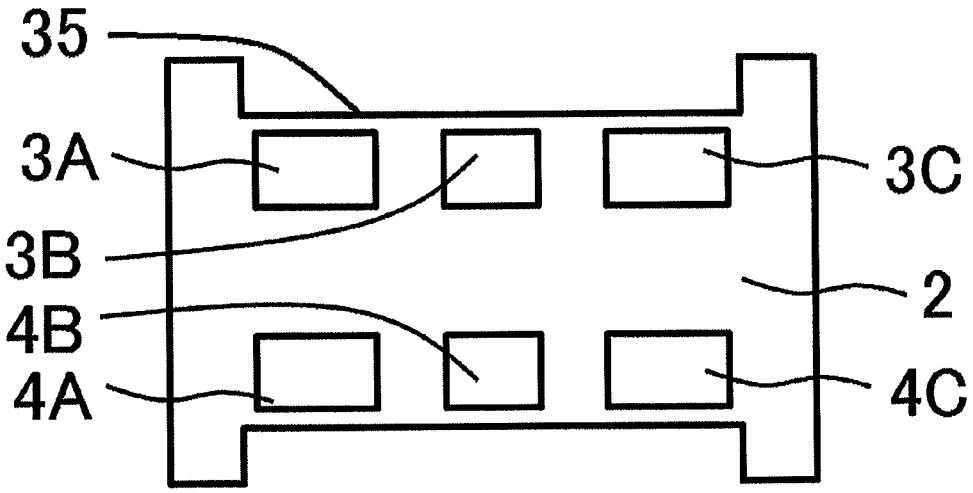

In the fuse device 40, as illustrated in FIG. 18A, the first and the second electrodes 3, 4 may be separated to form first separated electrodes 3A to 3C and second separated electrodes 4A to 4C which correspond to mounting positions of the element components 31A to 31C or the elements 34 of the fuse element 30. In the same manner, in the fuse device 50 as well, as illustrated in FIG. 18B, the first and the second electrodes 3, 4 may be separated to form first separated electrodes 3A to 3C and second separated electrodes 4A to 4C which correspond to mounting positions of the element components 31A to 31C or the elements 51 of the fuse element 30.

By separating the first electrode into the first separated electrodes 3A to 3C and by separating the second electrode 4 into the second separated electrodes 4A to 4C, mounting displacement and unintentional pooling of solder caused by solder surface tension can be suppressed during solder bonding of the element components 31A to 31C or the elements 34, 51 of the fuse element 30.

REFERENCE SIGNS LIST

Reference Signs List

1 fuse device, 2 insulating substrate, 2*a* surface, 2*b* back surface, 3 first electrode, 4 second electrode, 5 fuse element, 5*a* low melting point metal layer, 5*b* high melting point metal layer, 7 antioxidation film, 10 protective member, 10*a* protective case, 11 adhesive agent, 12 housing body, 13 cover, 14 openings, 17 flux, 20 covering member, 30 fuse element, 31 element components, 33 terminal portions, 34 elements, 35 engagement recess, 40 fuse device, 50 fuse device, 51 elements

The invention claimed is:

1. A fuse element constituting a current path of a fuse device in which self-generated heat caused by a rate-exceeding current flowing therethrough causes blowout of the fuse element comprising:

a low melting point metal layer; and a high melting point metal layer laminated onto the low melting point metal layer, the high melting point metal layer having a melting point higher than a melting point of the low melting point metal layer;

wherein the fuse element is connected between two electrodes on an insulating substrate and connected onto the electrodes by a solder at a reflow temperature of the solder, wherein the fuse element has a laminated structure in which the low melting point metal layer is an inner layer and the high melting point metal layer is an outer layer laminated on an upper surface and on a lower surface of the low melting point metal layer, and wherein the melting point of the low melting point metal layer and a melting point of the solder are equal to or lower than 260° C., and wherein the low melting point metal layer and the solder are melted at the reflow temperature of the solder.

2. The fuse element according to claim 1, wherein the low melting point metal layer is a solder; and wherein the high melting point metal layer is Ag, Cu, or an alloy having Ag or Cu as a primary constituent.

3. The fuse element according to claim 1, wherein a volume of the low melting point metal layer is greater than a volume of the high melting point metal layer.

4. The fuse element according to claim 1, wherein a film thickness ratio of the low melting point metal layer to the high melting point metal layer is between 2:1 and 100:1.

5. The fuse element according to claim 1, wherein the low melting point metal layer has a film thickness of 30 μm or more, and wherein the high melting point metal layer has a film thickness of 3 μm or more.

6. The fuse element according to claim 1, wherein the high melting point metal layer is formed by plating on a surface of the low melting point metal layer.

7. The fuse element according to claim 1, wherein the high melting point metal layer is formed by applying a metallic foil to a surface of the low melting point metal layer.

8. The fuse element according to claim 1, wherein the high melting point metal layer is formed onto a surface of the low melting point by a thin film deposition process.

9. The fuse element according to claim 1,
wherein the high melting point metal layer has an anti-oxidation film formed on a surface thereof.

10. The fuse element according to claim 1,
wherein the low melting point metal layer and the high melting point metal layer are laminated in a plurality of alternating layers.

11. The fuse element according to claim 1,
wherein the low melting point metal layer is coated by the high melting point metal layer excluding two opposing end surfaces.

12. The fuse element according to claim 1,
wherein the fuse element is protected by a protective member on at least a portion of the exterior thereof.

13. The fuse element according to claim 1,
wherein the fuse element comprises a plurality of element components arranged in parallel; and
wherein the plurality of element components blow due to self-generated heat caused by a rate-exceeding current flowing therethrough.

14. The fuse element according to claim 13,
wherein the plurality of element components blow in a sequence.

15. The fuse element according to claim 14,
wherein all or part of cross-sectional area of one element component is smaller than cross-sectional area of other element components.

16. The fuse element according to claim 13,
wherein the plurality of element components comprise three element components arranged in parallel; and
wherein a central element component of the plurality of element components blows last.

17. The fuse element according to claim 16,
wherein all or part of cross-sectional area of the central element component is smaller than cross-sectional area of the element components which are located on both sides of the central element component.

18. The fuse element according to claim 1, further comprising:
a terminal portion which is used as an external-connection terminal of the fuse device.

19. The fuse element according to claim 3,
wherein the high melting point metal layer has a film thickness of 0.5 μm or more.

20. The fuse element according to claim 1,
wherein the fuse element utilizes an action in which the low melting point metal layer erodes the high melting point metal layer and blowout occurs when a rate-exceeding current flows through the fuse element.

21. The fuse element according to claim 5,
wherein the high melting point metal layer is Ag or an alloy having Ag as a primary constituent.

22. A fuse device comprising:
an insulating substrate; and
a fuse element which is blown by self-generated heat when a rating-exceeding current flows therethrough mounted above the insulating substrate;
wherein the fuse element comprises a low melting point metal layer and a high melting point metal layer laminated onto the low melting point metal layer, the high melting point metal layer having a melting point higher than a melting point of the low melting point metal layer,
wherein the fuse element is connected between two electrodes on an insulating substrate and connected onto the electrodes by a solder at a reflow temperature of the solder,
wherein the fuse element has a laminated structure in which the low melting point metal layer is an inner layer and the high melting point metal layer is an outer layer laminated on an upper surface and on a lower surface of the low melting point metal layer, and
wherein the melting point of the low melting point metal layer and a melting point of the solder are equal to or lower than 260° C., and
wherein the low melting point metal layer and the solder are melted at the reflow temperature of the solder.

23. The fuse device according to claim 22,
wherein the fuse element is mounted such that an interval exists between the fuse element and the insulating substrate.

24. The fuse device according to claim 22,
wherein the fuse element has a flux coated to a surface thereof.

25. The fuse device according to claim 22,
wherein vicinities above the insulating substrate are enclosed by a covering member.

26. The fuse device according to claim 22,
wherein the fuse element comprises a plurality of the fuse elements arranged in parallel or a plurality of the element components arranged in parallel; and
wherein the fuse element is blown by self-generated heat caused by a rate-exceeding current flowing therethrough.

27. The fuse device according to claim 26,
wherein the plurality of the fuse elements or the plurality of element components blow in a sequence.

28. The fuse device according to claim 27,
wherein all or part of cross-sectional area of one of the plurality of the fuse elements or one of the plurality of element components is smaller than cross-sectional area of other members among the plurality of the fuse elements or the plurality of element components.

29. The fuse device according to claim 26,
wherein the plurality of the fuse elements or the plurality of element components comprise three fuse elements or three element components arranged in parallel; and
wherein a central fuse element or a central element component blows last.

30. The fuse device according to claim 29,
wherein all or part of cross-sectional area of the central fuse element or the central element component is smaller than cross-sectional area of the fuse elements or element components which are located on both sides of the central fuse element or the central element component.

31. The fuse device according to claim 27,
wherein the plurality of the fuse elements or the plurality of the element components are arranged in parallel between a first and a second electrodes provided on the insulating substrate; and
wherein the first and the second electrodes have projecting portions at positions to which one of the plurality of the fuse elements or the plurality of element components connects and electrode distance therebetween is shorter than electrode distance between positions to which others of the plurality of the fuse elements or the plurality of element components connect.

32. The fuse device according to claim 28,
wherein the plurality of the fuse elements or the plurality of element components are arranged in parallel between a first and a second electrodes provided on the insulating substrate; and wherein the first and the second electrodes have projecting portions at positions to which one of the plurality of the fuse elements or the plurality of element components connects and electrode distance therebetween is shorter than electrode distance between positions to which others of the plurality of the fuse elements or the plurality of element components connect.

33. The fuse device according to claim 29, wherein the plurality of the fuse elements or the plurality of element components comprise three fuse elements or three element components which are arranged in parallel between a first and a second electrodes provided on the insulating substrate; and wherein the first and the second electrodes include projecting portions at positions to which a central fuse element or a central element component connects and electrode distance therebetween is shorter than electrode distance between positions to which others of the plurality of the fuse elements or the plurality of element components connect.

34. The fuse device according to claim 30, wherein the plurality of the fuse elements or the plurality of element components comprise three fuse elements or three element components which are arranged in parallel between a first and a second electrodes provided on the insulating substrate; and wherein the first and the second electrodes include projecting portions at positions to which a central fuse element or a central element component connects and electrode distance therebetween is shorter than electrode distance between positions to which others of the plurality of the fuse elements or the plurality of element components connect.

35. The fuse device according to claim 26, wherein the fuse element has a terminal portion used as an external-connection terminal formed thereon.

36. The fuse device according to claim 35, wherein the fuse element is connected such that the terminal portion protrudes above a surface of the insulating substrate; and wherein the terminal portion and a covering member cover blowout regions of the fuse element.

37. The fuse device according to claim 35, wherein the terminal portion of the fuse element is fitted to a side surface of the insulating substrate.

38. The fuse device according to claim 37, wherein the insulating substrate has a heat-dissipating electrode formed on a surface opposite to a surface on which the fuse element is mounted.

39. The fuse device according to claim 26, wherein the fuse element is connected to the insulating substrate by an adhesive agent.

40. The fuse device according to claim 26, wherein the first and the second electrodes are separated in positions corresponding to locations to which the plurality of the fuse elements or the plurality of element components are mounted.

41. The fuse device according to claim 22, wherein the fuse element has a terminal portion used as an external-connection terminal formed thereon; and wherein the fuse element blows due to self-generated heat caused by the rate-exceeding current flowing therethrough.

42. The fuse device according to claim 41, wherein the fuse element is connected such that the terminal portion protrudes above a surface of the insulating substrate; and wherein the terminal portion and a covering member cover blowout regions.

43. The fuse device according to claim 41, wherein the terminal portion of the fuse element is fitted to a side surface of the insulating substrate.

44. The fuse device according to claim 43 further comprising:

a heat-dissipating electrode formed on a side of the insulating substrate opposite to a side on which the fuse element is mounted.

45. The fuse device according to claim 22, wherein the low melting point metal layer has a film thickness of 30 μm or more, and wherein the high melting point metal layer has a film thickness of 3 μm or more.

46. The fuse device according to claim 22, wherein the fuse device utilizes an action in which the low melting point metal layer erodes the high melting point metal layer and blowout occurs when a rate-exceeding current flows through the fuse device.

* * * * *